US005410427A

United States Patent [19]

Huignard et al.

[11] Patent Number: 5,410,427

[45] Date of Patent: Apr. 25, 1995

[54] METHOD FOR THE DETECTION, RECOGNITION AND USE OF SIGNALS MIXED WITH OTHER ENCODING OR PARASITIC SIGNALS, AND APPARATUS FOR PERFORMING THE METHOD

[75] Inventors: Jean C. P. Huignard, Créteil; Patrick Sauvin, Ris Orangis; Ouzana Bazzi, Valenciennes; Roger Torguet, Saint Saulve, all of France

[73] Assignee: Sodena, Nord, France

[21] Appl. No.: 633,623

[22] Filed: Dec. 26, 1990

[30] Foreign Application Priority Data

Dec. 27, 1989 [FR] France ..... 89 17271
Oct. 3, 1990 [FR] France ..... 90 12206

[51] Int. Cl.[6] ..... G02F 1/33

[52] U.S. Cl. ..... 359/306; 359/311; 364/822

[58] Field of Search ..... 359/306, 311; 364/822

[56] References Cited

U.S. PATENT DOCUMENTS 3,457,425 7/1969 Preston, Jr. ..... 364/822
4,602,852 7/1986 Moroz ..... 359/311

FOREIGN PATENT DOCUMENTS 0201020 11/1984 Japan ..... 359/306

*Primary Examiner*—Georgia Y. Epps
*Assistant Examiner*—Evelyn A. Lester
*Attorney, Agent, or Firm*—Cushman Darby & Cushman

[57] ABSTRACT

The invention is a method that considerably improves the rapidity of collection and recognition of electrical signals that are mixed with other signals that impede direct access. The subject of the invention is a method for detection, recognition and use of significant trains of modulated signals on a carrier frequency. The apparatus which provides for the method utilizes a sole crystalline Bragg cell wherein two signal trains travel colinearly through the cell.

25 Claims, 3 Drawing Sheets

FIG. 4
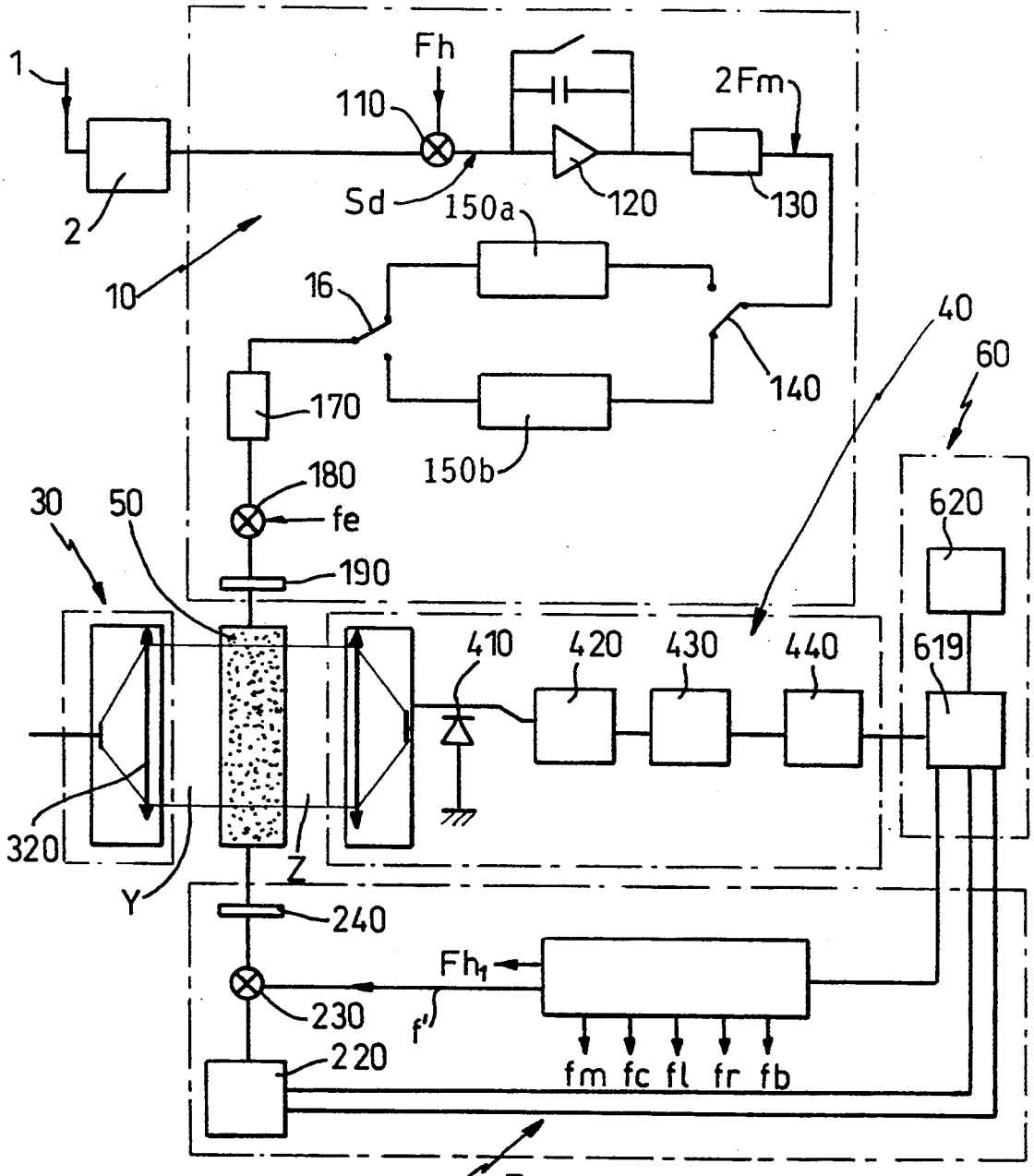
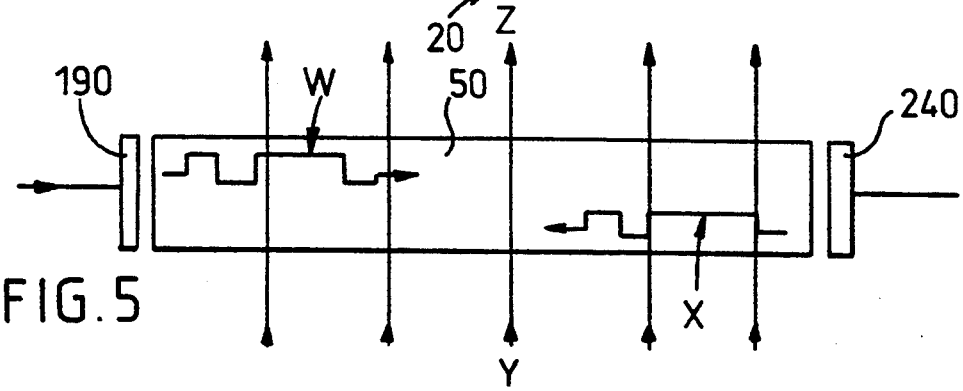
FIG. 5

FIG.6
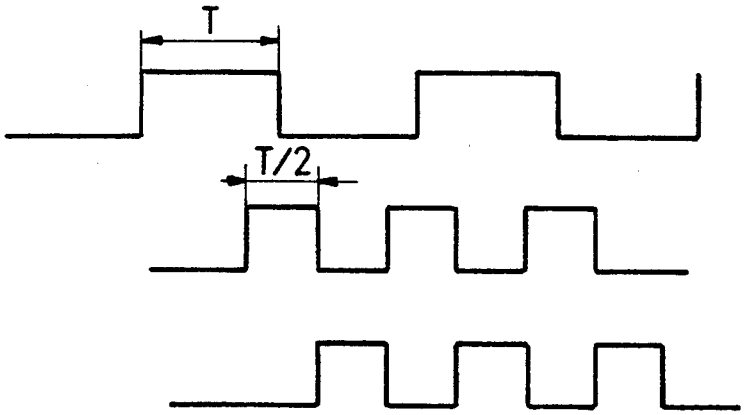
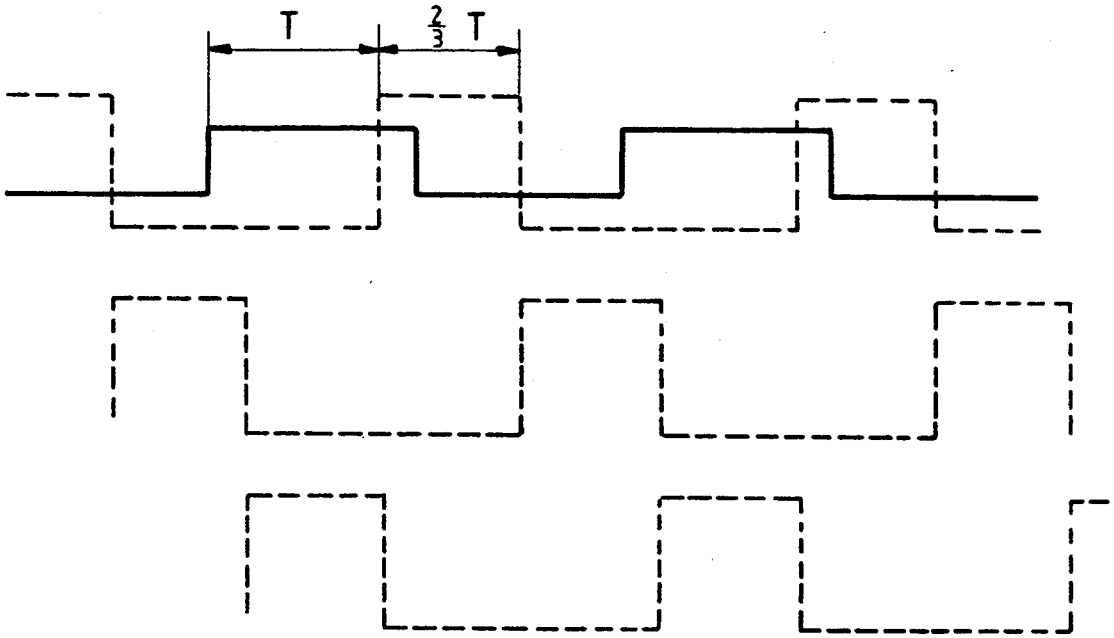
FIG.7

METHOD FOR THE DETECTION, RECOGNITION AND USE OF SIGNALS MIXED WITH OTHER ENCODING OR PARASITIC SIGNALS, AND APPARATUS FOR PERFORMING THE METHOD

BACKGROUND OF THE INVENTION

1. Field of the Invention

The present invention relates to an apparatus enabling the collection and recognition of electrical signals that are mixed with other signals that impede direct access; these other signals may be either intentional parasitic signals (hostile jamming) or unintentional ones (under transmission conditions), or encoding signals for protection against recognition of characteristic signals by an unauthorized person.

2. Description of the Prior Art

Any noncharacteristic signals that impede the detection and recognition of signals that comprise messages, such as data transmission, orders or other significant elements, are generally classified as "noise".

One application of the method according to the invention relates to radionavigation and position-finding systems that include a receiver for signals transmitted by a set of transmitter beacons. The beacons are either located on Earth (on the ground or at sea) or on satellites. Periodically and synchronously, they emit encoded signals containing the three exact spatial and temporal coordinates of the transmission. By cross-referencing the propagation delays and the spatial coordinates of signals transmitted by several beacons, the navigation or position-finding system can calculate the position of its receiver.

There are other applications of the invention as well, such as in the telecommunications field, especially for decoding purposes.

As is well known per se, significant signals are superimposed on a fixed-frequency transmission, known as a "carrier frequency", or more simply, "carrier".

In the prior art, the signals are collected by a collector means such as an antenna, a coaxial cable, an electro-optical cable or the like, depending on the chosen transmission system.

The collector is associated with a receiver, which performs the demodulation of the signals received, to separate the carrier frequency from the significant signals that are to be decoded.

After this conventional preprocessing, electrical signals, comprising the wave to be recognized and noise, are then processed.

The wave to be recognized is generally a succession of fixed-frequency bits, a bit being defined as either a voltage level, that is, +V or −V, or the alternation of two voltages: from −V to +V (generally from −5 V to +5 V) or from +V to −V.

With a view to the recognition of desired signals (trains of elementary signals) on the desired carrier, one known method comprises performing what is known in mathematics as a convolution; it involves generating a train of signals similar to the train to be recognized, and finding the product of the two trains, which a priori are out of phase. The summation of this product over the length of the test train comprises the outcome of the convolution. The product of convolution is a function of the displacement between the test train and the train to be recognized.

It is known that this product is maximal when both trains are in phase, that is, when their displacement is zero.

A peak value of the product of convolution thus means that there is perfect coincidence between the test train and the train received, i.e., it is recognized that the received train is indeed the train that was sought.

These operations are generally performed electronically. The test train and the received train are compared bit by bit (elementary signal by elementary signal); that is, to compose the test train, a first bit that is identical to the first bit of the train to be recognized is generated; then this first bit is put in phase with the first bit of the received train; then a second bit, identical to the second bit of the train to be recognized, is generated; then this second bit is put in phase with the second bit of the train to be recognized; and so forth.

As soon as any bit generated for the test train is not in phase with the corresponding bit of the received train, the first bit generated is put in phase again with a new received bit, and the process starts over, until each of the bits of the test train are exactly in phase with each of the corresponding bits of the received train.

This method is very time-consuming, and despite the improvement it provides in the operating speed of the associated processing units (computers), it slows down the recognition of the received trains substantially. For example, when this method is used in a radionavigation system, it delays the determination of the position of the receiver, and consequently it yields erroneous information, since by the time the position is found, the moving body that carries the receiver will have traveled onward a certain distance, and will then be at a different position from the one indicated.

The uncertainty engendered by the slowness of this method may be of small importance for certain slow-moving bodies; but for very fast-moving bodies, such as missiles, satellites, supersonic aircraft, and the like, it becomes critical.

Currently, the highest-powered systems include a Bragg cell, which is an acousto-optical transducer essentially comprising a crystalline body that receives both radiation and the received electronic signals; these signals influence the returned radiation.

The Bragg cell is thus associated with the receiver and modulates a beam of light as a function of the signals received. Means are provided for generating a train of signals corresponding to a train to be recognized, and for introducing it into the Bragg cell in a direction substantially parallel to the direction of propagation of the signals received. At least one optoelectronic detector is disposed downstream of the Bragg cell (in terms of the direction of propagation of the beams in the crystalline body), and a processing unit associated with the optoelectronic detector determines the variations in modulation of the beams, either to deduce the instant of synchronization of the received train and the test train, or to slide the test train relative to the trains received until synchronization is obtained, which by definition occurs if and when the optoelectronic detector receives a maximum light intensity, which corresponds to the maximum of the convolution function.

With a system of this type, the time needed to synchronize the test train and the train to be recognized depends essentially on the product of the period of the train to be recognized multiplied by the number of bits in a train, because the product of convolution must be found as many times as there are bits in a train, and the duration of a product of convolution is the period of the train to be recognized.

SUMMARY OF THE INVENTION

The present invention relates to a method that considerably improves the rapidity of such a process, either for decoding signals or for recognizing trains as described above in order to obtain rapid synchronization of a test train and a received train, despite the presence of pronounced noise masking the signals.

To this end, the subject of the invention is a method for the detection, recognition and use of significant trains of modulated signals on a carrier frequency that are mixed with other signals, of the type in which a test train corresponding to the train to be recognized is generated, both trains having coordinated profiles; then the electrical signals of these trains are converted into ultrasonic signals; then the test train and a received train, after conversion into ultrasonic signals, are carried to a sole crystalline body of the Bragg cell type, so that the two trains travel in parallel through the sole crystalline body, characterized in that, simultaneously, a laser beam is aimed into the same sole crystalline body but in a direction substantially perpendicular to the previous one, that is, at the Bragg angle, so that the rays of the laser beam are deflected in one direction by the test train and in the same direction by the received train; then the resultant rays are analyzed upon their exit from the sole crystalline body; then the deflected rays are extracted from the resultant rays; and then, for each bit of the trains, the undeflected rays, the once-deflected rays, and the twice-deflected rays are taken into account in order to compare them.

In other characteristics of this method:

the test train and the received train are carried in the sole crystalline body in two opposite ways in the same direction;

the test train and the received train (W) are carried in the sole crystalline body (50) both in the same way in the same direction;

the rays of the laser beam are demodulated upon their exit from the sole crystalline body at a frequency twice that of the ascertained displacement between a nondeflected ray and a once-deflected ray;

the amplitude of the rays of the laser beam is demodulated upon their exit from the sole crystalline body at a frequency twice that of the test frequency being propagated in the sole crystalline body;

to distinguish a nondeflected ray from a twice-deflected ray, the frequency difference between them, resulting from the Doppler effect, is measured;

the resultant rays are analyzed upon their exits from the sole crystalline body; then, for each train bit to be taken into account, and to achieve optical heterodyning, the frequency of the ultrasonic signal is slaved to the frequency of the received train as a function of the amplitude of the frequency difference, resulting from the Doppler effect, between a twice-reflected ray and a nondeflected ray;

the length of the train to be recognized in transit in the sole crystalline body is greater than that of the corresponding test train;

the longest train to be recognized is equal at most to the length of the sole crystalline body;

the shortest train to be recognized is less than half that of the sole crystalline body;

a compression of the trains is performed, so that at least one of the complete trains can in its entirety be inside the sole crystalline body;

the signal is sampled and memorized at a given frequency; then said signal is reread at a higher frequency than the given frequency;

a laser beam of arbitrary cross section is emitted and then converted optically so that it extends, within the sole crystalline body, in a layer located in a plane perpendicular to the direction of the trains;

the information stored in each digital memory is read out at a reading frequency higher than the writing frequency, in order to adapt the duration of the read-out train to be processed to the propagation characteristics specific to the sole crystalline body; then the test train generated is adapted to this same duration;

the signal received is demodulated and integrated over periods that are at least equal in duration to a fraction of that of one elementary bit of the train to be recognized; that the result of this integration is converted into digital signals; and that these digital signals are stored, in at least one digital memory, at the transmission frequency of the train to be recognized;

the signal received is demodulated and integrated over a period that is equal in duration to that of one elementary bit of the train to be recognized;

a number of values of the result of the integration, which result corresponds to a successive sampling of the signal received, that is at least equal to twice the number of elementary bits in the train to be recognized is stored in at least one digital memory;

two series of values are memorized at the frequency of the train to be recognized, one of the series corresponding to the value of the result of the integration over a duration coinciding with that of the first half of the period of integration, and the other of the series corresponding to the value of the result of the integration over a period coinciding with that of the second half of the period of integration.

The subject of the invention is also an apparatus for the detection, recognition and use of significant trains of modulated signals on a carrier frequency that are mixed with other signals, of the type including a generator of a test train corresponding to the train to be recognized, both trains having coordinated profiles; a converter converting the electrical signals of these trains into ultrasonic signals; and a crystalline body of the Bragg cell type, provided with connections for a test train and for a received train, characterized in that it includes a receiver-demodulator of signal trains to be recognized, a generator of test signal trains, a sole crystalline body of the Bragg cell type, to which the receiver-demodulator and the generator are respectively connected, wherein a laser beam projector and a receiver of the rays originating in the beam are both placed facing the two opposite sides of the crystalline body, this receiver of rays being associated with a detector capable of differentiating among the nondeflected rays, the once-deflected rays and the twice-deflected rays.

In other characteristics of this apparatus:

the receiver of rays is associated with a demodulator adjusted to demodulate electrical signals having a frequency differing by a factor of two from that of the ultrasonic signal being propagated in the sole crystalline body;

the demodulator associated with the receiver of rays includes a frequency meter the sensitivity of which is adapted for perceiving the possible differences between the frequency of the direct rays and the frequency of the deflected rays, this frequency meter being connected to a computer;

it includes, first, a switch that authorizes alternative access to one of the two memories in which the values of the train to be recognized are stored, and second, a switch that authorizes alternative access to the memory in which the values of the test train are stored;

it includes means for acquisition of the trains to be recognized, which include, in combination, an integrator, an analog/digital converter, and at least two memories that must contain the digital values of the trains to be recognized, and means for transcription of the values of the memorized trains to be recognized, which include, in combination, a digital/analog converter and a modulator, and that it includes at least one memory that must contain the values of the test trains;

it includes a filter of the bandpass type and an envelope detector, which are disposed between the receiver and the threshold detector;

it includes means for handling the synchronization of successive recognitions of trains to be recognized and determining the peaks of correlation, and at least one threshold detector.

The invention will be better understood from the ensuing detailed description, taken in conjunction with the drawings. It is understood that the description and the drawings are provided solely by way of non-limiting example.

BRIEF DESCRIPTION OF THE DRAWINGS

FIG. 4 is a block diagram of the entire apparatus.

FIG. 5 is a fragmentary diagram showing the routing of ultrasonic signals through the Bragg cell.

FIG. 6 is a schematic view that graphically shows the signal and its integration over a duration corresponding to one-half of a period of an elementary bit.

FIG. 7 is a schematic view that graphically shows the signal and its integration over a duration corresponding to two-thirds of a period of an elementary bit.

DETAILED DESCRIPTION OF THE PRESENT PREFERRED EXEMPLARY EMBODIMENTS

Figure 1:
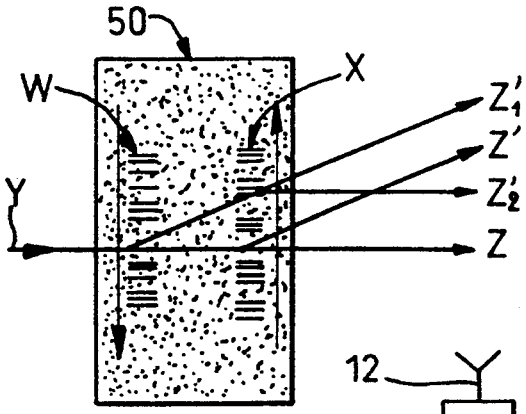
FIG. 1 is a diagram showing the phenomenon of deflection of light rays by an electromagnetic signal, such as that produced according to the invention, upon their exit from a Bragg cell.

Turning now to FIG. 1, the phenomenon of reflection of light rays by an electromagnetic signal at the exit of a crystalline body 50 of the Bragg cell type. This Bragg cell 50, modulates a light signal as a function of the signals received. To this end, it aims light rays, originating in a laser beam, at the entry to one of the sides of the Bragg cell 50. The electromagnetic waves of electrical signals are also converted into ultrasonic signals. Next, after their conversion into ultrasonic signals, a test train X and a received train W are introduced into the inside of the Bragg cell, in a direction substantially perpendicular to that of the light rays.

Advantageously, the test train X and the received train W are introduced into the Bragg cell 50 either in a common plane in two opposite directions or in a common plane in the same direction.

Some of the light rays Y of the laser beam are first reflected in a determined direction, at an angle corresponding to the Bragg angle, by the received train W and then by the test train, forming two distinct resultant beams of rays (Z'2, Z'1). The first beam of rays Z'2 is propagated in a direction parallel to the direction of introduction of the light rays Y. The second beam of rays Z'1 is propagated in a determined direction parallel to the Bragg angle.

Similarly, those light rays Y of the laser beam that are not reflected by the train W are reflected in a determined direction by the test train X into a beam of reflected rays (Z'). This beam of rays Z' is propagated in a determined direction corresponding to the direction of the Bragg angle, so as to be parallel to the beam Z'1. The result at the exit from the Bragg cell is a distribution of the laser beam Y into four distinct beams Z'1, Z', Z'2 and Z.

Thus according to the invention, by using appropriate electronic means, the reflected rays (Z', Z'and Z'2) are separated from the nonreflected rays Z, and the nonreflected rays Z, the rays (Z'1 and Z') that have been reflected once, and the rays (Z'2) that have been reflected twice are analyzed by comparison methods.

Figure 2:
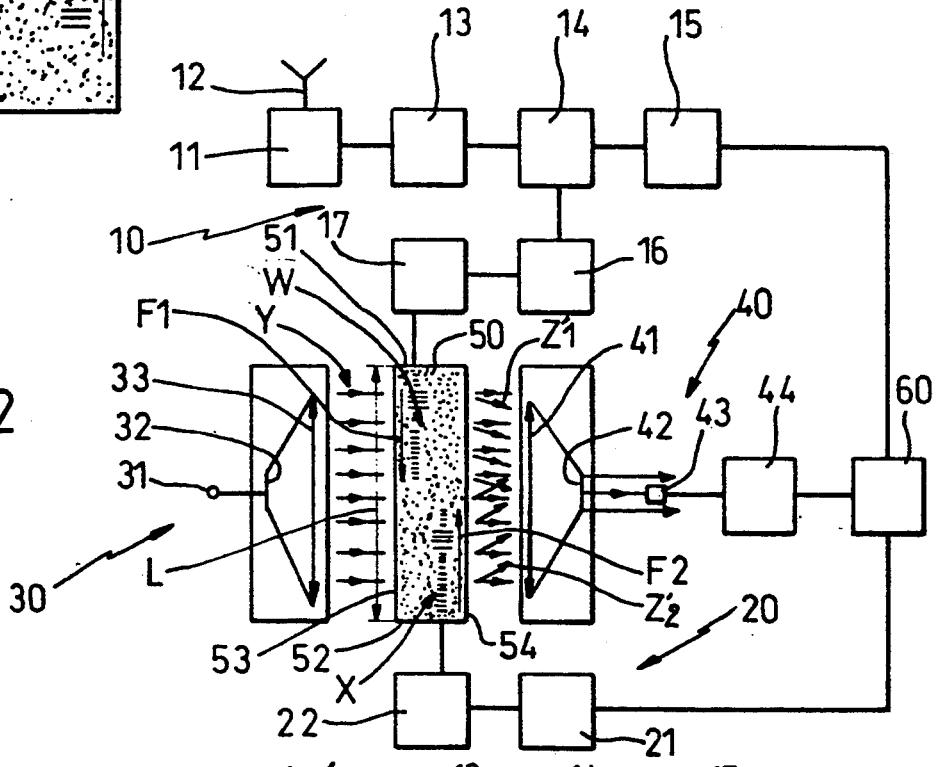
FIG. 2 is a diagram showing the invention at the functional moment when a test train and a received train are propagated in a Bragg cell in opposite directions and are not in phase.

Turning to FIG. 2, it can be seen that a method according to the invention is incorporated into an apparatus that includes the following:

a set 10 for processing the trains to be received,
a set 20 for processing the test trains,
a set 30 for emitting radiation in the form of light,
a set 40 for receiving the light radiation,
a Bragg cell 50,
a computer 60 accompanied by a means for furnishing data.

The set 10 includes a radio receiver 11, provided with an antenna 12, a demodulator 13, a memory 14, a reader 15 for reading the memory 14, a modulator 16, and a transducer 17 that receives electrical signals corresponding to the trains received and furnishes ultrasonic signals to the side 51 of the Bragg cell 50.

The set 20 includes a modulator 21, which by a program for commanding the computer 60 generates electrical signals corresponding to the test trains and sends them to a transducer 22, which furnishes ultrasonic signals to the opposite side 52 of the Bragg cell 50 from the side 51.

The set 30 includes a light source 31 and optical means 32–33 located facing a side 53 of the Bragg cell 50 adjacent to its two opposed sides 51 and 52.

The set 40 includes optical means 41–42, which are located facing the side 54 of the Bragg cell 50 that is adjacent to the sides 51 and 52 and hence is opposite the side 53, and which focus the light radiation received from the source 31 through the Bragg cell 50 to a photoelectric device such as a photodiode 43 connected to a demodulator 44.

The radiation source 31 is a laser projector, the beam of which is converted by the optical means 32–33 into a sheet of parallel rays that extend in a plane that is perpendicular both to the sides 51 and 52 and to the side 53 and 54, or in other words is located in the plane of the drawing.

This apparatus employs the method of the invention and functions in the following manner:

The demodulator 13 extracts the received signal trains, which are carried on a known frequency to which the receiver is tuned. Each of these trains constitutes a signal sampling system introduced into the memory 14. The sampling is performed at the frequency f1 of the signal.

Reading of the memory 14 is done at a frequency known as the "reading frequency" FL, and the modulator 16 furnishes a signal at a frequency known as the "signal frequency" FS.

The electrical signal furnished by the photodiode 43 is demodulated by the demodulator 44 at the frequency 2FS, and the result of the demodulation, which is the product of convolution, is detected and recorded by the computer 60.

Simultaneously, the computer 60 generates the frequency FL as well as trains of electrical signals at the frequency FL, each train being the reversal over time of the train to be recognized. The latter train is modulated at the frequency FS by the modulator 21, which is the same type as the modulator 16, and is introduced into the Bragg cell 50 by the transducer 22.

In FIG. 2, the received train W and the test train X are out of phase, and the parallel rays of light Y at the entry to the side 53 are deflected at the exit of the side 54 into the rays Z'1 and/or Z'2, relative to their orientation Z (which if it were unchanged would obviously be the same as that of the output rays Y), in the direction of propagation of the trains W and X indicated by the respective arrows F1 and F2. The value of this deflection is:

$$\frac{-V\lambda}{FS}$$

which is frequency-shifted by the value of FL, V being the speed of ultrasonic propagation in the Bragg cell crystal and the wavelength of the radiation Y-Z.

Figure 3:
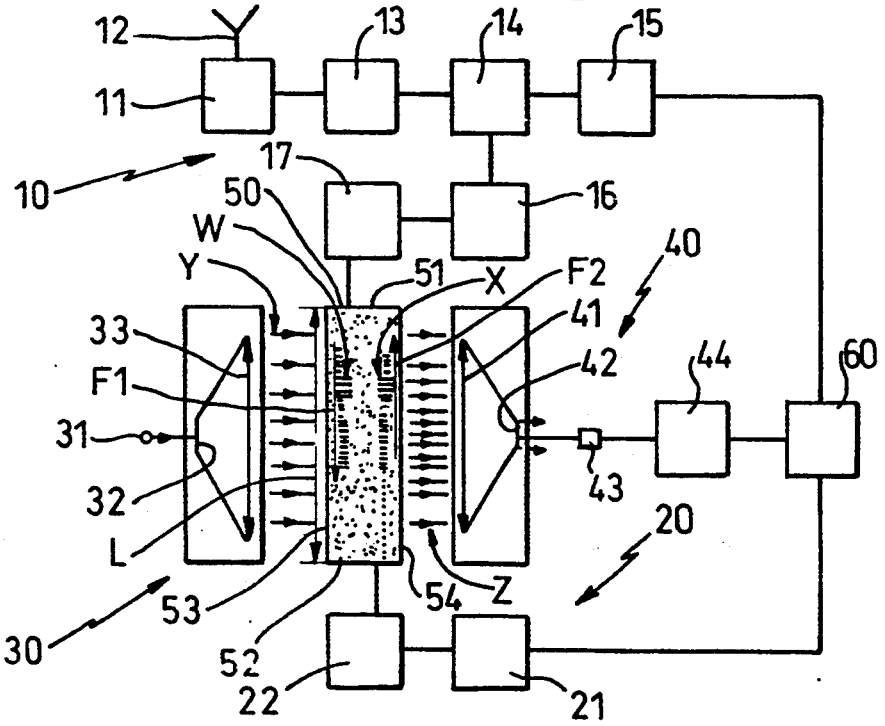
FIG. 3 is a diagram showing the invention at the functional moment when a test train and a received train are propagated in a Bragg cell in opposite directions and are in phase.

In FIG. 3, the two trains, the received train S and the test train X, are similar and superimposed on one another, and rays deflected once by:

$$\frac{+V\lambda}{F}$$

are deflected a second time by:

$$\frac{-V\lambda}{F}$$

by being frequency-shifted by 2FS. In the photodiode, these rays interfere with the rays that have not been deflected and have not been frequency-shifted.

Thus the received trains W are propagated in the crystal of the Bragg cell 50 until the moment when they are superimposed on the test trains X that are being propagated in the opposite direction. At the moment when the two trains W and X are superimposed, the product of convolution attains a maximum value, which is easy to detect by physical means.

Using only a single Bragg cell makes for a compact apparatus, thus eliminating the problems of heterogeneity of material or in the deviation of beams of light that can arise if two attached Bragg cells are used.

In another advantageous feature of the invention, compressing the electrical signals of the trains to be recognized makes it possible to assign the ultrasonic signal W a length that does not exceed one-half the length L of the cell 50 (this length is the distance separating the opposite sides 51 and 52).

The compression of the signal is effected either in analog fashion, or digitally, by an electronic circuit of a known type that is part of the set of the receiver 11 and demodulator 13, so that this set will furnish compressed signals.

The compression comprises sampling the signals received at the frequency f1, and storing the values sampled in the (analog or digital) memory 14, the capacity of which is at least N bits (N is at least twice the number of bits in the trains to be recognized). The N successively sampled bits are assigned to N successive addresses in the memory 14.

After a sampling of N values of the signals received and an assignment of these N samples to their successive addresses, a reading of the N successive samples stored in the memory 14 at a reading frequency FL higher than F1 makes it possible to generate ultrasonic signals, which are the compression of the electrical signals received.

The value of FL is selected such that:

$$\frac{(N)\cdot V}{FL} < L$$

which signifies that the total length of the ultrasonic signal (N bits of duration, 1/FL multiplied by the speed of propagation V of the ultrasonic signal) is less than the length L of the cell 50.

Because of the compression of the ultrasonic signal introduced into the cell 50, its processing time is shortened by the factor FL/f1, which makes it possible to make a plurality of convolution attempts during the time for sampling the signal received and filling the memory; this time equals N/fl.

In this version, each test train X is generated in reverse over time relative to the corresponding train W to be recognized, and in accordance with the reading frequency FL, such that the two trains W and X, that is, the one to be recognized and the test train, can be effectively superimposed on one another.

Finally, the convolution function of the signals of the two trains W and X being propagated in the opposite direction in the cell 50 is proportional to the electrical signal transmitted to the computer 60 via the demodulator 44 by the photodiode 43 for receiving the laser beam Z that has passed through the cell 50.

In fact, in an advantageous version of the invention, the received and test signals W and X are associated with (multiplied by) a stable signal having a fixed frequency FS that is higher than FL.

A signal of stable frequency FS that is propagated in a cell comprises a plane network known aptly as a "Bragg network". The effect of a Bragg network on a laser beam is to deflect some of the light by:

$$\frac{V\lambda}{FS}$$

and to shift the frequency of the light rays by:

FS

A significant proportion of the light is not deflected and maintains its basic frequency; it is of the zero (0) order.

The effect of the test trains is thus to deflect some of the light rays in the direction of propagation of the test trains by an angle equal to $$\frac{V\lambda}{FS}$$

to increase the frequency of the deflected rays by the value FS, this being the +1 order, and to deflect a quasi-negligible proportion of the light rays in the opposite direction by lowering their frequency by the value FS, this being the −1 order.

The effect of the received trains is to deflect some of the light rays in the direction of propagation of the received trains by an angle that this time is equal to:

$$\frac{-V\lambda}{FS},$$

and to increase the frequency of the reflected rays by the value FS. A negligible proportion is deflected by an angle equal to $$\frac{+V\lambda}{FS},$$

with a lowering of frequency by +Fs.

When the trains are exactly superimposed on one another, the beam of light includes a nondeflected term having a fundamental frequency, superimposed on a term deflected by:

$$\frac{+V\lambda}{FS} - \frac{V\lambda}{FS} = 0$$

and having a frequency that is twice-increased, hence by 2 FS.

This term interferes with the 0 order, and the frequency of the modulation of the amplitude of the interference is 2 FC.

When the trains are out of phase, part of the light is deflected by $$\frac{+V\lambda}{FS},$$

with a shift of +FS, and another part is deflected by $$\frac{-V\lambda}{FS},$$

with the same shift of FS, but there is no compensation for either the deflection nor the beam frequency-shifted by 2 FS.

Thus by this principle, the photoelectric conversion device, such as the photodiode 43, receives the 0 order by way of an optical element, and the electronic signal output by the photodiode 43 is proportional to the amplitude of the light received.

The luminous intensity is modulated at 2 FS, when the received and test trains W and X are superimposed.

This is why the apparatus includes a demodulator 44 at the frequency 2 FS in phase with the modulation signal.

Consequently, a positive or negative maximum of the demodulated function corresponds to a superposition of two trains, the received train W and the test train X, respectively.

Except for the sign, the result of the convolution is the demodulation of the luminous intensity signal at the frequency 2 FS.

Hence the apparatus makes it possible to verify the recognition of the signals, at the exact moment of their arrival, by ascertaining a convolution peak at the moment of detection.

The development of the convolution signal can constitute a signal corresponding to the decoding of the received signal.

As has been noted above, a "bit by bit" comparison of two families of rays, phase-modulated as a function of a phase difference of 0 or $\pi$, is performed.

Furthermore, the 0 order is taken into account in order to achieve optical heterodyning and hence to obtain an amplitude response that gives the relative value of the sign of the signal.

It is understood that variant embodiments of the invention that will be apparent to one skilled in the art may be made without departing from the scope of the invention. In particular, the optical systems may be different from those precisely described herein. One skilled in the art will readily be able to achieve the modes for signal compression, modulation and demodulation depending on the intended applications, and so they need not be described in further detail beyond that already given here.

In particular, a conventional, known kind of pulse compression is used that is often employed in systems where the signal-to-noise ratio at the entry to a signal analysis and processing apparatus is negative. This signal-to-noise ratio defines the signal quality, and it is mathematically determined by the following formula:

$$\Sigma = 10 \log_{10} \frac{\text{mean power of the useful signal}}{\text{mean power of the noise}}$$

In the GPS system, for example, this ratio is highly negative (on the order of −20 decibels). It is then necessary to obtain a compression factor of 30 dB to enable detecting the signal at the exit with a gain of 10 dB. To obtain such results, pseudo-random codes are used, the duration of which is equivalent to one millisecond and which have 1023 elementary bits.

To perform these various operations, electronic calculating means of a known type are used.

The test train and the received train are compared bit by bit, that is, elementary signal by elementary signal. The test train is thus compensated by generating a first bit identical to the first bit of the train to be recognized; then this first bit is put in phase with the first bit of the received train. Next, a second bit identical to the second bit of the train to be recognized is generated; then this second bit is put in phase with the second bit of the received train; and so forth.

As soon as a bit generated for the test train is not in phase with the corresponding bit of the received train, the first bit generated is put in phase again with a new received bit, and the process starts over, until each of the bits of the test train are exactly in phase with each of the corresponding bits of the received train.

Despite the improvement in the rapidity of operating speed of the associated processing units, such as computers, this method is still very time-consuming and complicated to use. In certain cases where the position of the transmitter is determined by the receiver, its slowness may be a source both of error and of highly deleterious uncertainty.

To overcome this disadvantage, faster systems currently exist, which include a Bragg cell, that is, an acousto-optical transducer essentially comprising a crystalline body that receives both radiation and the received electronic signals; these signals influence the returned radiation.

The Bragg cell is thus associated with the receiver and modulates a beam of light as a function of the signals received. Means are provided for generating a train of signals corresponding to a train to be recognized, and for introducing it into the Bragg cell in a direction substantially parallel to the direction of propagation of the signals received. At least one optoelectronic detector is disposed downstream of the Bragg cell (in terms of the direction of propagation of the beams in the crystalline body), and a processing unit associated with the optoelectronic detector determines the variations in modulation of the beams, either to deduce the instant of synchronization of the received train and the test train, or to slide the test train relative to the trains received until synchronization is obtained, which by definition occurs if and when the optoelectronic detector receives a maximum light intensity, which corresponds to the maximum of the convolution function.

With these systems, the time needed to synchronize the test train and the train to be recognized depends essentially on the product of the period of the train to be recognized multiplied by the number of bits in a train, as described above, for the sake of fast synchronization of a test train and a received train despite the presence of pronounced noise masking the information-carrying signals.

It is of primary importance that the Bragg cells used, and the signal to be processed, be adapted to one another.

It should be noted that in the majority of applications, the significant signal is carried by a high-frequency signal. Now when this high-frequency signal has an unknown shift, as is the case with radionavigation and position-finding systems that receive the signals output by transmitters disposed on a satellite, recognition of the information transmitted becomes difficult.

The invention considerably improves the rapidity with which the maximum light intensity, which corresponds to the maximum of the convolution function, can be determined while enabling compensation for background noise.

Turning now to FIG. 4, it can be seen that a method according to the invention is performed with an apparatus that includes the following, in combination:

an antenna 1 and an amplifier 2,
a set 10 for processing the trains to be recognized,
a set 20 for processing the test trains,
a set 30 for emitting light rays,
a set 40 for receiving the light rays,
a Bragg cell 50,
a computer assembly 60 for processing and storing data.

In the majority of applications of this method and of the apparatus for performing it, the signal received is one that is carried by carrier waves transmitted at a frequency in the range from $10^8$ Hz and $10^{10}$ Hz, and preferably at a frequency on the order of a gigahertz, that is, $10^9$ Hz.

In the entire ensuing description, this frequency will be referred to by the symbol Fh.

In the particular context of the application to satellite positioning, based on the system such as that currently known as the GPS system, the code output by the satellites thus modulates this high frequency in such a way as to transmit a signal carried by carrier waves of medium frequency, generally approximating one megahertz, that is, a frequency of $10^6$ Hz. In the entire ensuing description, this frequency will be referred to by the symbol Fm.

The transmission of this code is performed for a length of time that substantially corresponds to 1000 periods of the mean frequency Fm. It is repeated with a constant sign at a frequency on the order of one kilohertz, that is, $10^3$, herein referred to as Fr, and it changes its sign at a frequency on the order of 50 Hz, or Fb.

It will be understood that in applications other than that of satellite positioning by the GPS system, the frequencies used may be different, but the signal processing will be analogous.

This signal processing to be described below enables recognition and processing of a code that is carried by a signal, for example embedded within the noise, and is mixed with other codes that can be recognized in succession.

In the context of the application to the GPS system, the high-frequency signal received is assigned a frequency shift for various reasons, and in particular to prevent its recognition by unauthorized persons. This frequency shift is unknown, and it is generally obtained by the Doppler effect, which is a phenomenon that occurs when a source of vibration (sound, ultrasonic sound) or electromagnetic radiation (light, radio waves, etc.) of a given frequency is in motion relative to an observer, which is perceived by the observer as a modification in the frequency received. Naturally it is also conceivable for any other type of apparatus that enables the generation of a frequency shift to be used.

This frequency shift is on the order of $10^4$ Hz and will be referred to as dFh in the entire ensuing description, in the context of the GPS application.

The signal Fh+dFh is received by an antenna 1. After being received, this signal is amplified by an amplifier 2, which has been adjusted beforehand so that it is calibrated to a frequency substantially equal to Fh.

The signal Fh+dFh is then modulated by a modulator 110 in such a manner as to correspond to a signal having a base frequency of Fm minus dFh.

The demodulated signal Sd is integrated by an integrator 120 for a period of time corresponding to one-half the period of the signal l*a* (of base Fm) to be recognized, that is, a duration equal to one-half of an elementary bit of the code to be recognized. After this integration, this signal is converted into a digital signal having the frequency 2 Fm by an analog/digital converter 130.

This digital signal at the frequency 2 Fm is stored alternatively in one of two memories 150*a*, 150*b* by a switch 140, which switches in alternation with a frequency identical to that of the digital signal, that is, a switching frequency of 2 Fm. In this way, the 2046 consecutive values of two successive encoded signals are stored, with the GPS signal comprising 1023 successive values.

At the end of each half-period, the integration of the signal is re-initialized. Similarly, the analog/digital conversion and a change in state of the switch 140 are also performed.

The filling time of the two memories 150*a* and 150*b* is effected for a period of time that corresponds to the time needed to transmit two successive codes, that is, about two milliseconds.

Hence after the memorization of these two codes, one of the memories, 150*a* or 150*b*, contains a code that is synchronized with that of the sampling, while the other memory, 150*b* or 150*a*, contains a code that is desynchronized by two milliseconds.

Although the onset of the memorization of the code in the two memories 150*a* and 150*b* can be synchronized with respect to the reception of the onset of this code, the code is integrally recorded in the memories 150*a* and 150*b*, because the time required to load it into these memories 150*a* and 150*b* is more than twice the total duration of the code per se, which is recorded in two milliseconds.

While the memory 150*b* is being loaded (with the switch 140 in the lower position), the codes previously memorized in the memory 150*a* are read at a reading frequency F1 greater than the base frequency Fm, in order to compress the signal for its introduction into the digital/analog converter 170 preceding the Bragg cell 50.

The compression of the signal thus makes it possible to use the smallest possible Bragg cell 50, because the signal to be processed is adapted to the cell, rather than vice versa.

This temporal compression of the signal by digital means, by means of acquisition and readout in two different memories, makes it possible, for a GPS-type signal, to obtain a ratio of close to 8 between the reading frequency and the acquisition frequency.

Nevertheless, in order to be able to realize and obtain such a ratio, conventional methods, and especially the one known as the Shannon method cannot be used. The GPS system receiver in fact uses a signal that is necessarily embedded in noise, and the Shannon method, for example, would either require excessive sampling to eliminate this chance of background noise, or might produce an incorrect result if too few samples were used.

The solution that the invention provides for this problem comprises finding the energy of the elementary bit of the train to be recognized by an integration of this bit, then converting the value of the integral into digital information.

Adequate sampling, which enables fast reading and hence a ratio that assures compression to the value best adapted to the capabilities of the Bragg cell, is thus achieved; with the GPS system, for example, the ratio is as follows:

$$\frac{\text{reading frequency}}{\text{acquisition frequency}} = 20$$

This processing of the elementary bit is perfectly linear processing. Nevertheless, because the synchronization with the train received is purely random and unknown, it is impossible to guaranteed a duration of integration that corresponds exactly to that of an elementary bit.

To achieve this, the integration is performed for a limited duration, which at maximum corresponds to a one-half period of an elementary bit, and the number of integrated values is doubled; the integration of these values is done as shown in FIG. 6. To do this, the integration is performed by doubling the number of integrated values, such that the second value is integrated during a period corresponding to the period of nonintegration of the first value.

Choosing integration for a length of time corresponding to a one-half period of an elementary bit, although it causes a 3 dB attenuation of the signal-to-noise ratio, because half the energy of the signal is used, advantageously makes it possible to attain rapid, simple automatic control by limiting the number of successive attempts. Rapid, faithful acquisition of values is thus obtained.

It is also conceivable to effect the integration over a limited duration that corresponds to some other fraction of the period of the elementary bit of the code to be recognized, as shown in FIG. 7, where this integration is performed for a duration equal to two-thirds of the period of an elementary bit.

The table below compares the duration of integration, with respect to the duration of an elementary bit, with the attenuation of the signal-to-noise ratio in decibels, as well as the number of successive attempts necessary for satisfactory results.

| Integration Duration | Number of Attempts | Drop in signal-to-Noise Ratio |
|---|---|---|
| $\frac{2}{3}$ T | 3 | 1.7 dB |
| $\frac{3}{4}$ T | 4 | 1.2 dB |
| $\frac{7}{8}$ T | 8 | 0.6 dB |

From this table, it can be seen that the closer the duration of integration with respect to an elementary bit is to its period, the more attempts are necessary;

the closer the duration of integration with respect to an elementary bit is to its period, the greater the tendency of the attenuation of the signal-to-noise ratio to be a low value.

Hence it is clear that the number of attempts increases considerably when integration durations close to the period of the elementary bit are considered.

Reading of the memories 150*a*–150*b* is authorized by the switch 160. In the case of FIG. 1, the switch 160, in the upper position, enables readout of the memory 150*a*.

These digital codes are converted into an analog signal by the digital converter 170, and this signal is then modulated by a disregard modulator 180 at a frequency higher than the reading frequency f1. This highest frequency is equal to that of an acoustical carrier wave and will hereinafter be referred to by the symbol fc. A transducer 190 converts this signal into an ultrasonic wave.

After this conversion, the sound signal is transmitted to the Bragg cell 50 in order to interfere with the light rays output by a set 30 that includes a light source, constituted by a laser 300 the beam of which is converted by optical means 320, known per se, into a sheet of parallel rays extending to the cell 50 in a plane perpendicular to the Bragg angle.

After passing through the cell 50, the parallel rays are focused as described above.

The compression of the received, processed signal must be the more pronounced, the higher the propagation speed of the ultrasonic wave.

Moreover, the signal received at the frequency Fm is modulated at the frequency dfh, which corresponds to the random shift in the frequency of the GPS receiver. As a result of this shift, the signal generated at the frequency fl is modulated by the shift and compressed as well, as defined by the following formula:

$$\frac{(fl)}{(fm)} \times (dfh)$$

This frequency shift affects code recognition.

To permit this recognition of the code received, and in particular of the train to be recognized, several conditions must be met. These are:

The code carried by the received signal W and the code carried by the test code of the test train X must be capable of being superimposed on one another for their entire length.

the test code of the test train X must be output in reverse over time, to enable the propagation of a wave that is equivalent to the received signal W.

The effect of the frequency shift corresponding to the formula $$\frac{(fl)}{(fm)} \times (dfh)$$

must be compensated for.

To obtain this superimposition, a computer 61, in synchronization with the onset of the readout of the signal received, generates a double reversed readout over time, at a frequency fl, of the code of the train to be recognized. This code is stored in the memory 620 of the computer. This code is converted into a digital signal by a digital/analog converter 220, and it is modulated by a modulator 230 at a frequency f' identical to the frequency of the acoustical carrier. It is finally converted, by an ultrasonic transducer 240 located at a second end of the electro-acoustic cell, into an acoustical signal X that is propagated in the electro-acoustic cell.

The acoustical frequency is determined by means of successive attempts until the desired value is attained; this value is defined by the formula:

$$f' = (fc) + \frac{(fl)\,(dfh)}{(fm)}$$

In this way, the frequency shift of the signal received, with a demodulation having a value of dfh, is compensated for at the level of the modulation at the acoustical frequency f' by an equivalent shift, and because of this, recognition of the train to be recognized is possible.

In this embodiment of the invention, the four superposition conditions are in fact met.

The superposition of the received code W by the test code of the test train corresponds to a maximum amplitude of the modulation of the laser beam Y passing through the Bragg cell 50 and interacting with the two ultrasonic waves.

To this end, the laser beam is modulated at a frequency defined by the formula:

$$(2fc) + \frac{(dhf)\,(fl)}{(fm)}$$

and the maximum amplitude of this modulation corresponds exactly to the instant of recognition.

To detect the recognition of this superposition, an electro-optical receiver 410, a photodiode the output signal of which can be amplified, and a threshold detector 440 are used. In a series-connected arrangement, a bandpass filter 420, having a central band equal to 2fc as its characteristic, and an envelope extractor are also disposed between the electro-optical receiver and the threshold detector.

To enable the detection of the train to be recognized, a threshold need merely be exceeded.

The computer 610 handles the memorization of the received signal and the various attempts at correlation as a function of the trains to be recognized, which are searched for in the memory 620. It also handles the attempts at recognition, which are made for various values of the frequency deviation dfh and for the various values of the corresponding peak correlations.

All these various frequency values, that is, fh, fc, $f'_1$, $f'_2$, $f'_3$, . . . , fl, fm, fr and fb, are generated by an oscillator 21.

In the context of the GPS system application, the computer associates one instant of recognition with each code recognized, and it deduces the temporal displacement between the recorded signal of the received code and the onset of the recording.

By means of this recognition, dated by several codes, the position of the receiver can thus be determined.

In other applications, such as in telecommunications, this method and the apparatus for performing it enable the detection and decoding of encoded signals that are embedded in noise and are inaccessible to any receiver that does not know the code or the carrier frequency.

I claim:

1. A method for detection, recognition and use of trains of modulated signals on a carrier frequency that are mixed with other signals, said method comprising:

receiving a train to be recognized;

generating a test train corresponding to the train to be recognized, said test train having a profile coordinated with a profile of said train to be recognized;

converting electrical signals of each train into ultrasonic signals;

providing the converted test train and the converted received train to a sole crystalline body of the Bragg cell type so that the two trains travel colinearly through said sole crystalline body in a common plane;

directing a laser beam into the sole crystalline body in a first direction of substantially normal angle to said common plane, said substantially normal angle being at the Bragg angle so that rays of the laser beam are deflected in a second direction by the test train and by the received train and so that resultant rays including non-deflected rays, once-deflected rays and twice-deflected rays exit from said sole crystalline body;

extracting the non-deflected rays, the once-deflected rays and the twice-deflected rays from the resultant rays; and analyzing and comparing the non-deflected rays, the once-deflected rays, and the twice-deflected rays of the respective test train and received train.

2. The method of claim 1, said providing step comprising a step of:

applying the test train and the received train to the sole crystalline body in a common plane and in opposite directions.

3. The method of claim 1, said providing step comprising a step of:

applying the test train and the received train to the sole crystalline body in a common plane and in the same direction.

4. The method of claim 1 further comprising the steps of:

determining a displacement between a non-deflected ray and a once-deflected ray; and amplitude-demodulating the resultant rays at a frequency twice that of the determined displacement.

5. The method of claim 1 further comprising the step of:

amplitude-demodulating the amplitude of the resultant rays of the laser beam at a frequency twice that of a frequency of the test train.

6. The method of claim 1, said analyzing step comprising a step of:

measuring a Doppler effect frequency difference between a non-deflected ray and a twice-deflected ray to distinguish between the non-deflected ray and the twice-deflected ray.

7. The method of claim 1, comprising the further steps of:

determining an amplitude of a Doppler effect frequency difference between a twice-deflected ray and a non-deflected ray; and slaving a frequency of the ultrasonic signals to a frequency of the received train as a function of said determined amplitude to achieve optical heterodyning.

8. The method of claim 1, wherein a length of the train to be recognized in transit in the sole crystalline body is greater than that of the corresponding test train.

9. The method of claim 8, wherein a longest train to be recognized is less than or equal to a length of the sole crystalline body.

10. The method of claim 8, wherein a length of a shortest train to be recognized is less than half that of the sole crystalline body.

11. The method of claim 10 further comprising a step of;

compressing at least one of said trains so that said at least one of said trains can be entirely inside the sole crystalline body.

12. The method of claim 1, said receiving step comprising steps of:

sampling and memorizing a signal of the received train at a given frequency; and rereading said signal at a higher frequency than the given frequency.

13. The method of claim 1, said directing step comprising a step of:

emitting and converting optically a laser beam of arbitrary cross section so that it extends, within the sole crystalline body, in a layer located in a plane normal to the common plane.

14. The method of claim 1, said receiving step comprising steps of:

storing said received train as information in at least one digital memory at a writing frequency;

reading out the information stored in each digital memory at a reading frequency higher than the writing frequency to adapt a duration of the read-out train to propagation characteristics specific to the sole crystalline body; and adapting the test train to the duration of the read-out train.

15. The method of claim 1, said receiving step comprising steps of:

demodulating and integrating a signal of the received train over periods that are at least equal in duration to a fraction of a duration of one elementary bit of the received train;

converting the demodulated and integrated signal into a digital signal; and storing said digital signal in at least one digital memory at a transmission frequency of said train to be recognized.

16. The method of claim 15, wherein said period is equal in duration to a period of one elementary bit of the train to be recognized.

17. The method of claim 15, said storing step comprising a step of:

storing a number of values produced by said demodulating and integrating step corresponding to a successive sampling of the train to be recognized, said number being at least equal to twice a number of elementary bits in the train to be recognized is stored in at least one digital memory.

18. The method of claim 15, said storing step comprising a step of:

storing two series of values at a frequency of the train to be recognized, a first one of the series corresponding to a value of an integration over a duration coinciding with a first half of a period of integration, and a second one of the series corresponding to a value of integration over a period coinciding with a second half of the period of integration.

19. An apparatus for detection, recognition, and use of trains of modulated signals on a carrier frequency that are mixed with other signals, said apparatus comprising:

means for receiving and demodulating a train to be recognized as a first electrical signal;

generator means for generating a test train corresponding to the train to be recognized as a second electrical signal so that said test train has a profile coordinated with said train to be recognized;

means for converting the first and second electrical signals into ultrasonic signals;

a sole crystalline body of the Bragg cell type to which the receiving and demodulating means and the generator means are respectively connected;

laser means for generating a laser beam passing through said sole crystalline body disposed on a first side of said sole crystalline body; and receiver means for receiving said laser beam disposed on a second side of the crystalline body [(50)]opposite said first side of said crystalline body, said receiver means including detector means for differentiating among non-deflected rays, once-deflected rays and twice-deflected rays in said received laser beam.

20. The apparatus of claim 19, said receiver means further comprising:

a demodulator for demodulating electrical signals having a frequency differing by a factor of two from that of the ultrasonic signals generated by said converter means.

21. The apparatus of claim 19, said receiver means further comprising a demodulator including:

a frequency meter having a sensitivity suitable for perceiving differences between a frequency of non-deflected rays and a frequency of deflected rays; and a computer connected to said frequency meter.

22. The apparatus of claim 19 further comprising:

first switch means for alternately establishing access to one of two memories in which values of the train to be recognized are stored; and second switch means for alternately establishing access to a memory in which values of the test train are stored.

23. The apparatus of claim 19, said receiving means further comprising:

acquisition means for acquiring a train to be recognized including an integrator, an analog/digital converter, and at least two memories containing digital values of a train to be recognized; and transcription means for reading out values of memorized trains to be recognized including a digital-/analog converter, a modulator, and at least one memory containing values of the test train.

24. The apparatus of claim 23, further comprising:

a bandpass filter; and an envelope detector; wherein said bandpass filter and said envelope detector are disposed between the receiver means and a threshold detector.

25. The apparatus of claim 23, further comprising:

synchronization means for synchronizing successive recognitions of trains to be recognized and determining peaks of correlation; and at least one threshold detector.

* * * * *